US007494954B2

(12) United States Patent
Mito et al.

(10) Patent No.: US 7,494,954 B2
(45) Date of Patent: Feb. 24, 2009

(54) HEAT-SENSITIVE RECORDING MATERIAL AND PROCESS FOR PRODUCING THE SAME

(75) Inventors: Hisayoshi Mito, Amagasaki (JP); Takeshi Shikano, Amagasaki (JP); Keiichi Inubushi, Amagasaki (JP)

(73) Assignee: Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 11/651,999

(22) Filed: Jan. 11, 2007

(65) Prior Publication Data

US 2007/0111888 A1 May 17, 2007

Related U.S. Application Data

(63) Continuation-in-part of application No. PCT/JP2006/315827, filed on Aug. 10, 2006.

(30) Foreign Application Priority Data

Aug. 25, 2005 (JP) ..... 2005-243991

(51) Int. Cl.
*B41M 5/30* (2006.01)
*B41M 5/42* (2006.01)

(52) U.S. Cl. ..... 503/200; 503/226

(58) Field of Classification Search ..... None
See application file for complete search history.

(56) References Cited

U.S. PATENT DOCUMENTS

| | | | | |
|---|---|---|---|---|
| 4,798,820 | A * | 1/1989 | Yaguchi et al. | 503/207 |
| 4,923,845 | A * | 5/1990 | Koike et al. | 503/226 |
| 5,045,523 | A | 9/1991 | Funae et al. | 503/207 |
| 6,071,851 | A | 6/2000 | Wakamatsu | 503/200 |

FOREIGN PATENT DOCUMENTS

| | | | |
|---|---|---|---|
| JP | 3-176192 | A | 7/1991 |
| JP | 4-290789 | A | 10/1992 |
| JP | 6-239023 | A | 8/1994 |
| JP | 2001-30631 | A | 2/2001 |
| JP | 2002-274041 | A | 9/2002 |
| JP | 2002-283728 | A | 10/2002 |
| JP | 2003-11507 | A | 1/2003 |
| JP | 2004-122483 | A | 4/2004 |
| JP | 2004-124288 | A | 4/2004 |
| JP | 2004-269311 | A | 9/2004 |
| JP | 2005-103864 | A | 4/2005 |
| JP | 2006-175636 | A | 7/2006 |

* cited by examiner

*Primary Examiner*—Bruce H Hess
(74) *Attorney, Agent, or Firm*—Kubovcik & Kubovcik

(57) ABSTRACT

The present invention relates to a heat-sensitive recording material having a high recording sensitivity, which is capable of providing excellent image quality even when recording is carried out at low energy, and causes reduced coating defects. The invention provides a heat-sensitive recording material obtained by forming, on a paper support, an undercoat layer and then a heat-sensitive recording layer, characterized in that:

1) the undercoat layer has at least two undercoat layers including a first undercoat layer and a second undercoat layer; and 2) the heat-sensitive recording layer has a thickness standard deviation of 0.30 or less,
and also provides a method for producing the heat-sensitive recording material.

14 Claims, No Drawings

HEAT-SENSITIVE RECORDING MATERIAL AND PROCESS FOR PRODUCING THE SAME

This application is a continuation-in-part of international application PCT/JP2006/315827 filed Aug. 10, 2006, which claims priority of Japanese patent application No. 2005-243991 filed Aug. 25, 2005, each of which is incorporated herein by reference.

TECHNICAL FIELD

The present invention relates to a heat-sensitive recording material which utilizes a color forming reaction between a leuco dye and a developer, and to a method for producing the heat-sensitive recording material.

BACKGROUND ART

Heat-sensitive recording materials are well known, which use heat to obtain recorded images by utilizing a color development reaction between a leuco dye and a developer. Because such heat-sensitive recording materials are relatively inexpensive, and recording devices therefor can be relatively compact and easily maintained, they have been widely used, not only as recording materials for the output of facsimile machines and various computers, printers of scientific measuring instruments and the like, but also as recording materials for various printers for POS labels, ATMs, CAD, handy terminals, various ticket forms, and the like.

In order to improve the recording sensitivity and image quality of a heat-sensitive recording material, it is known to provide, between a support and a heat-sensitive layer, an undercoat layer in which a pigment and a binder are contained so that voids are formed therein to make it porous or bulky and to thereby impart thermal insulation properties. For example, it has been disclosed that, in order to obtain a uniform and stable undercoat layer structure, an undercoat layer coating composition having a specific viscosity may be applied by blade coating (patent document 1). It has also been disclosed that, in order to enhance the image quality of a heat-sensitive paper, variations in the thickness of an undercoat layer may be controlled within a specific range (patent document 2). It has been further disclosed that, in order to lower the coefficient of static friction of the surface, an undercoat layer having two or more layers may be formed by blade coating (patent document 3).

However, with recent increases in the speed of printing, the demand has grown for heat-sensitive recording materials having higher sensitivity and better image quality, and accordingly, it has been difficult to achieve sufficient quality simply by using a highly flat base paper or providing only an undercoat layer.

In methods for providing an undercoat layer, usually, a larger coating amount leads to an undercoat layer having better thermal insulation, thereby improving recording sensitivity. However, when the coating amount is larger, the formation of a uniform coating surface is less easy, making it difficult to make the subsequently formed heat-sensitive recording layer and protective layer uniform. As a result, recording sensitivity and image quality are lowered, and the barrier properties of the protective layer are impaired.

Further, in the heat-sensitive recording material market, which is now growing into a mature market, production costs have become an important issue. Accordingly, it would be difficult to employ, for actual production, coating techniques having low productivity or inducing coating defects, even if high-quality products can be thereby obtained.

[Patent document 1] Japanese Unexamined Patent Publication No. 1992-290789

[Patent document 2] Japanese Unexamined Patent Publication No. 2004-122483

[Patent document 3] Japanese Unexamined Patent Publication No. 2005-103864

DISCLOSURE OF THE INVENTION

PROBLEMS TO BE SOLVED BY THE INVENTION

In light of this situation, an object of the present invention is to provide a heat-sensitive recording material having a high recording sensitivity, which is capable of providing excellent image quality even when subjected to recording at low energy, and having reduced coating defects; and a method for producing the same.

MEANS FOR SOLVING THE PROBLEM

As a result of extensive research, the present inventors found that the above objects can be achieved by, for example, providing an undercoat layer with a multilayer structure of at least two layers, and then further forming a specific heat-sensitive recording layer on the undercoat layer. Based on this finding, the inventors have accomplished the present invention.

The present invention provides the following heat-sensitive recording materials and methods for producing the same.

Item 1. A heat-sensitive recording material comprising:

(i) a paper support, (ii) an undercoat layer formed on the paper support, and (iii) a heat-sensitive recording layer formed on the undercoat layer;

a) the undercoat layer having a multilayer structure comprising at least a first layer and a second layer that is formed on the first layer; and b) the heat-sensitive recording layer having a thickness standard deviation of 0.30 or less.

Item 2. A heat-sensitive recording material according to item 1, wherein the first undercoat layer and the second undercoat layer are formed from the same undercoat layer coating composition.

Item 3. A heat-sensitive recording material according to item 1 or 2, wherein the ratio of the dry coating amount of the first undercoat layer to the dry coating amount of the second undercoat layer is 2:8 to 8:2.

Item 4. A heat-sensitive recording material according to any one of items 1 to 3, wherein the total dry coating amount of the first undercoat layer and the second undercoat layer is 5 to 35 $g/m^2$.

Item 5. A heat-sensitive recording material according to any one of items 2 to 4, wherein the undercoat layer coating composition has a viscosity as measured by a Hercules viscometer at 8800 rpm of 25 to 40 mPa·s, and a viscosity as measured by a BL viscometer at 60 rpm of 700 to 2000 mPa·s.

Item 6. A heat-sensitive recording material according to any one of items 1 to 5, wherein the fist undercoat layer is formed by blade coating followed by drying, and the second undercoat layer is formed by rod coating followed by drying.

Item 7. A heat-sensitive recording material according to item 6, wherein, after the first undercoat layer is formed, the second undercoat layer is formed without winding the paper support provided with the first undercoat layer.

Item 8. A heat-sensitive recording material according to any one of items 1 to 7, wherein the heat-sensitive recording layer further comprises a pigment, and said pigment is in the form of secondary particles having an average particle diameter of 30 to 900 nm formed by agglomeration of amorphous silica primary particles having a particle diameter of at least 3 and less than 30 nm.

Item 9. A heat-sensitive recording material according to any one of items 1 to 8, further comprising a protective layer formed on the heat-sensitive recording layer.

Item 10. A heat-sensitive recording material according to item 9, wherein the protective layer comprises a pigment, and said pigment is in the form of secondary particles having an average particle diameter of 30 to 900 nm formed by agglomeration of amorphous silica primary particles having a particle diameter of 3 to 70 nm.

Item 11. A heat-sensitive recording material according to item 9 or 10, wherein the protective layer has a thickness of 0.4 to 2.5 μm.

Item 12. A method for producing a heat-sensitive recording material obtained by forming, on a paper support, an undercoat layer and then a heat-sensitive recording layer, the method comprising:

a first step of forming a first undercoat layer on the paper support by blade coating, followed by drying, and a second step of forming a second undercoat layer on the first undercoat layer by rod coating, followed by drying.

Item 13. A method according to item 12, wherein the second step is carried out after the first step without winding the paper support provided with the first undercoat layer.

Item 14. A method according to item 12 or 13, wherein coating compositions for forming the first undercoat layer and the second undercoat layer each have a viscosity as measured by a Hercules viscometer at 8800 rpm of 25 to 40 mPa·s, and a viscosity as measured by a BL viscometer at 60 rpm of 700 to 2000 mPa·s.

Hereinafter, the present invention is described in more detail.

The heat-sensitive recording material of the present invention is a heat-sensitive recording material obtained by forming, on a paper support, an undercoat layer and then a heat-sensitive recording layer, characterized in that:

1) the undercoat layer has at least two undercoat layers including a first undercoat layer and a second undercoat layer; and 2) the heat-sensitive recording layer has a thickness standard deviation of 0.30 or less.

In other words, the present invention provides a heat-sensitive recording material having:

(i) a paper support, (ii) an undercoat layer formed on the paper support, and (iii) a heat-sensitive recording layer formed on the undercoat layer;

a) the undercoat layer having a multilayer structure of at least a first layer (first undercoat layer) and a second layer (second undercoat layer); and b) the heat-sensitive recording layer having a thickness standard deviation of 0.30 or less.

Undercoat Layer

The undercoat layer has at least two layers. The number of layers in the undercoat layer is not limited so long as it is two or more, and an upper limit may be set at about four. The number of layers is especially preferably two.

When the undercoat layer has a multilayer structure of at least two layers, variations in permeability of a heat-sensitive recording layer and a protective layer can be greatly reduced. As a result, recording energy that coloring components contained in the heat-sensitive recording layer receive from the surface layer during recording can be effectively used, and accordingly, high sensitivity can be achieved. Further, variations in permeability of the protective layer are reduced, active ingredients therein for protecting the surface layer of the heat-sensitive recording layer are increased, and accordingly, barrier properties can be improved.

In the present invention, among plurality of layers forming the undercoat layer, at least two layers (first and second undercoat layers) may be formed of the same undercoat layer coating composition or alternatively of different undercoat layer coating compositions. It is preferable in the present invention that they be formed of the same undercoat layer coating composition. Use of the same undercoat layer coating composition enables batch preparation of the coating composition, thereby improving the yield of the coating composition, and reducing production costs.

The undercoat layer can be usually formed by applying, on a support, an undercoat layer coating composition containing, as main components, a binder and at least one pigment selected from the group consisting of i) oil-absorbing pigments having an oil absorption of about 70 ml/100 g or more, and preferably about 80 to about 150 ml/100 g, ii) organic hollow particles and iii) thermal expansion particles, followed by drying.

By using at least one pigment selected from the group consisting of oil-absorbing pigments, organic hollow particles and thermal expansion particles, voids in the undercoat layer are increased. When a heat-sensitive recording layer and the like are provided thereon, diffusion of thermal energy toward the base paper is prevented, and recording energy can be used more efficiently. Accordingly, a high image density can be obtained.

As used herein, the oil absorption is determined in accordance with JIS K 5101-1991.

Various oil-absorbing pigments can be used, and specific examples thereof include inorganic pigments such as calcined kaolin, silica, light calcium carbonate, talc, etc.

Such oil-absorbing pigments preferably have an average particle diameter of about 0.01 to about 5 μm, and more preferably about 0.02 to about 3 μm. As used herein, the average particle diameter is a 50 percent value determined using a laser diffraction particle size distribution analyzer (product name: "SALD 2000", product of Shimadzu Seisakusho Co.).

The amount of oil-absorbing pigment can be selected from a wide range, and it is generally preferable that the amount be about 50 to about 95 mass %, and particularly about 60 to about 90 mass %, of the pigments in the undercoat layer.

The organic hollow particles that can be used are those heretofore known, and examples thereof include particles having a void ratio of about 50 to about 99%, whose shells are formed of acrylic resin, styrene resin, vinylidene chloride resin, and/or the like. As used herein, the void ratio is a value determined by $(d/D)\times 100$, wherein d is the inner diameter of an organic hollow particle, and D is the outside diameter of the organic hollow particle.

Such organic hollow particles preferably have an average particle diameter of about 0.5 to about 10 μm, and particularly about 0.7 to about 2 μm. The average particle diameter is measured by the same method as in the measurement of the average particle diameter of the oil-absorbing pigment mentioned above.

The amount of organic hollow particles can be selected from a wide range, and it is generally preferable that the amount be about 20 to about 90 mass %, and particularly about 25 to about 70 mass %, of the pigments in the undercoat layer.

Various thermal expansion particles can be used, and specific examples thereof include thermal expansion fine particles obtained by microcapsulation of low-boiling hydrocarbons with copolymers such as vinylidene chloride and acrylonitrile by in-site polymerization, etc. Examples of low-boiling hydrocarbons include ethane, propane, etc.

The amount of thermal expansion particles can be selected from a wide range, and it is generally preferable that the amount be about 1 to about 80 mass %, and particularly about 10 to about 70 mass %, of the pigments in the undercoat layer.

When two or more classes of pigments selected from oil-absorbing inorganic pigments, organic hollow particles and thermal expansion particles are used together, it is preferable that the total amount thereof be about 40 to about 90 mass %, and particularly about 50 to about 80 mass %, relative to the total solids of the undercoat layer.

Other than oil-absorbing inorganic pigments, organic hollow particles and thermal expansion particles mentioned above, various known pigments for coating can be used in the undercoat layer, within a range that the effects of the present invention are not inhibited. Examples thereof include kaolin, ground calcium carbonate, titanium oxide, magnesium carbonate, aluminium hydroxide, synthetic mica, etc. These pigments can be used singly or in combination.

Examples of binders usable for the undercoat layer coating composition include polyvinyl alcohols of various molecular weights; modified polyvinyl alcohols; starch and derivatives thereof; methoxycellulose, carboxymethylcellulose, methylcellulose, ethylcellulose and like cellulose derivatives; sodium polyacrylate, polyvinyl pyrrolidone, acrylamide-acrylic acid ester copolymers, acrylamide-acrylic acid ester-methacrylic acid terpolymers, styrene-maleic anhydride copolymer alkali salts, polyacrylamides, sodium alginate, gelatin, casein and like water-soluble polymeric materials; and polyvinyl acetates, polyurethanes, styrene-butadiene copolymers, polyacrylic acids, polyacrylic acid esters, vinyl chloride-vinyl acetate copolymers, polybutyl methacrylate, ethylene-vinyl acetate copolymers, styrene-butadiene-acrylic copolymers, silylated urethanes, acrylic-silicone composites, acrylic-silicone-urethane composite emulsion and like hydrophobic polymer latices; etc. Such binders can be used singly or in combination.

The binder content of the undercoat layer is preferably 3 to 35 mass %, and more preferably 5 to 30 mass %, relative to the total solids of the undercoat layer. When the content is 3 mass % or more, the strength of a coating layer can be improved. When the amount is 35 mass % or less, the desired voids of the undercoat layer can be increased, and recording sensitivity can be enhanced.

Examples of auxiliaries include sodium alkylbenzene sulfonate, sodium dioctyl sulfosuccinate, sulfone-modified polyvinyl alcohols, sodium polyacrylate and like surfactants; glyoxal, boric acid, dialdehyde starch, methylolurea, epoxy-based compounds, hydrazine-based compounds and like waterproofing agents (crosslinking agents); zinc stearate, calcium stearate, polyethylene wax, carnauba wax, paraffin wax, ester wax and like lubricants; ultraviolet absorbers; fluorescent dyes; coloring dyes; release agents; antioxidants; etc. The amounts of auxiliaries can be suitably selected from a wide range.

Although the method for preparing the undercoat layer coating composition is not limited, and neither is the concentration of the coating composition, coating is usually carried out at a concentration of 20 to 50 mass %, and preferably 35 to 45 mass %. When the concentration is 20 mass % or more, the viscosity of the coating composition can be increased, variations in permeability and non-uniformity of the undercoat layer can be prevented, and image quality can be enhanced. At the same time, coating speed can be increased, and productivity can be increased. When the concentration is 50 mass % or less, the viscosity of the coating composition can be moderated, thereby simplifying the processing.

The undercoat layer coating composition for use in the present invention preferably has a viscosity as measured by a Hercules viscometer at a liquid temperature of 25° C. at 8800 rpm of preferably about 25 to about 40 mPa·s, and a viscosity as measured by a BL viscometer at a liquid temperature of 25° C. at 60 rpm of about 700 to about 2000 mPa·s. When the respective viscosities are 25 mPa·s or more and 700 mPa·s or more, the occurrence of variations in permeability can be prevented. As a result, a heat-sensitive recording material with high sensitivity and excellent image quality can be obtained more easily, and productivity can be improved at the same time. When the respective viscosities are 40 mPa·s or less and 2000 mPa·s or less, coating can be simplified, and as a result, the desired heat-sensitive recording material can be obtained more easily.

The viscosity of the undercoat layer coating composition can be suitably adjusted by selecting the kinds and amounts of pigments, binders, auxiliaries and so forth used in the preparation of the undercoat layer coating composition The coating amount of the undercoat layer is not limited, and may be suitably controlled so that the thickness of each undercoat layer is 3 to 12 μm (and preferably 5 to 10 μm), and the total thickness of the undercoat layers is 6 to 30 μm (and preferably 10 to 25 μm). The dry coating amount of each layer is preferably about 1 to about 15 g/m$^2$, and more preferably 2.5 to 10 g/m$^2$. The total dry coating amount of the undercoat layers is preferably about 2 to about 35 g/m$^2$, and more preferably 7 to 20 g/m$^2$.

It is particularly preferable that the ratio of the dry coating amount of the first undercoat layer to the dry coating amount of the second undercoat layer be 2:8 to 8:2, and more preferably 4:6 to 6:4.

When the ratio is within this range, the undercoat layer functions sufficiently as a heat insulating layer, and undesired permeability upon forming a heat-sensitive recording layer can be more effectively prevented. Accordingly, a heat-sensitive recording layer having reduced thickness variation can be formed.

Once the undercoat layer is formed, it preferably has a smoothness of 200 to 1200 seconds, and more preferably 300 to 1000 seconds. The smoothness is as measured by an Oken-type smoothness sensor (J.TAPPI No. 5).

The undercoat layer of the present invention is produced by forming a first undercoat layer by blade coating, and then forming second and subsequent undercoat layers by rod coating.

Generally, an undercoat layer is formed by Mayer bar coating, air-knife coating, blade coating, rod coating, or the like. As used herein, Mayer bar coating is a technique in which, after a coating composition is applied to paper typically by using a roll applicator, a bar composed of a metal cylinder and a thin wire wound around the metal cylinder is pressed thereto to scrape off the coating composition and thereby control the coating amount. Air knife coating is a technique in which a coating composition applied to paper, typically by a roll applicator, is scraped off by air pressure using high-pressure air ejected from a thin slit, thereby controlling the coating amount. These techniques are not suitable for high-speed coating, and undesirable in that productivity is thereby lowered.

Blade coating is a technique in which, after a coating composition is applied to paper by using a roll or jet-fountain applicator, a thin steel plate having a thickness of a few millimeters, as represented by a bevel type plate and a bent type plate, is pressed thereto to scrape off the coating composition and thereby control the coating amount. Such blade coating can form a highly smooth, uniform coating surface, but is undesirable in that coating defects such as streaks and scratches are likely to occur.

Rod coating is a technique in which a metal cylinder, in place of a thin steel plate, is pressed while being rotated to scrape off the applied coating composition and thereby control the coating amount. This technique causes a relatively small number of coating defects, but is undesirable in that when coating a coating surface having a low smoothness, such as a base paper, it is difficult to obtain a uniform coating surface. As used herein, rod coating and Mayer bar coating are clearly distinguished, and rod coating herein does not include Mayer bar coating.

In contrast, in the case the heat-sensitive recording material of the present invention, a first undercoat layer is formed by blade coating to give a uniform and highly smooth coating surface, and further one or more undercoat layers are formed thereon by rod coating, enabling the production of a uniform, highly smooth undercoat layer having reduced coating defects. Due to the interaction of these coating systems, it is possible to overcome the above-described drawbacks and achieve high sensitivity and excellent image quality.

In the formation of the undercoat layer of, for example, two layers, it is preferable to employ a technique such that a first layer is applied to a base paper reeled out from an unwinder, then dried, and subsequently, without a winding step, a second layer is applied thereto, dried, and then wound. Specifically, it is preferable that, after forming a first undercoat layer, the paper support provided with the first undercoat layer thus obtained be not wound at that time, but a second undercoat layer is formed thereon and the resulting product is then wound. If the support is wound after forming the first layer prior to forming the second undercoat layer, a highly flat coating surface formed by blade coating (i.e., the first undercoat layer surface) might be adversely affected, because the rear surface of the base paper comes into contact with the coating surface. In contrast, when such a winding step is not employed during the formation of the undercoat layers, the second undercoat layer can be formed while the coating surface formed by blade coating remains highly smooth, and it thus is possible to provide second and subsequent undercoat layers with highly smooth coating surfaces.

In the present invention, after forming second and subsequent undercoat layers by, for example, rod coating, smoothing processing such as supercalendering may be performed depending on the desired quality.

Heat-sensitive Recording Layer

The heat-sensitive recording layer of the present invention contains any of various known leuco dyes, developers, and binders. If necessary, sensitizers, pigments, various auxiliaries, and the like may also be contained.

Specific examples of leuco dyes include 3-(4-diethylamino-2-ethoxyphenyl)-3-(1-ethyl-2-methylindol-3-yl)-4-azaphthalide, Crystal violet lactone, 3-(N-ethyl-N -isopentylamino)-6-methyl-7anilinofluoran, 3-diethylamino-6-methyl-7-anilinofluoran, 3-diethylamino-6-methyl-7-(o,p -dimethylanilino)fluoran, 3-(N-ethyl-N-p-toluidino)-6-methyl-7-anilinofluoran, 3-pyrrolidino-6-methyl-7-anilinofluoran, 3-di(N -butyl)amino-6-methyl-7-anilinofluoran, 3-(N-cyclohexyl-N -methylamino)-6-methyl-7-anilinofluoran, 3-diethylamino-7-(o -chloroanilino)fluoran, 3-diethylamino-7-(m -trifluoromethylanilino)fluoran, 3-diethylamino-6-methyl-7-chlorofluoran, 3-diethylamino-6-methylfluoran, 3-cyclohexylamino -6-chlorofluoran, 3-(N-ethyl-N-hexylamino)-6-methyl-7-(p -chloroanilino)fluoran, 3-di(n-pentyl)amino-6-methyl-7-anilinofluoran, 3-(N-isoamyl-N-ethylamino)-7-(o -chloroanilino)fluoran, 3-(N-ethyl-N-2-tetrahydrofurfurylamino)-6-methyl-7-anilinofluoran, 3-diethylamino-6-chloro-7-anilinofluoran, 3-(N-n-hexyl-N-ethylamino)-6-methyl-7-anilinofluoran, 3-[N-(3-ethoxypropyl)-N-ethylamino]-6-methyl-7-anilinofluoran, 3-[N-(3-ethoxypropyl)-N-methylamino]-6-methyl-7-anilinofluoran, 3-diethylamino-7-(2-chloroanilino)fluoran, 3-(N-ethyl-p-toluidino) -6-methyl-7-(p-toluidino)fluoran, 3-piperidino-6-methyl-7-anilinofluoran, 3-diethylamino-7-(o-fluoroanilino) fluoran, 3-(4-dimethylamino)anilino-5,7-dimethylfluoran, etc. Such leuco dyes can be used singly or in combination.

Developers can be used singly or in combination. Specific examples of developers include 4-hydroxy-4'-isopropoxydiphenylsulfone, 4-hydroxy-4'-allyloxydiphenylsulfone, 4,4'-isopropylidenediphenol, 4,4'-cyclohexylidenediphenol, 2,2-bis(4-hydroxyphenyl)-4-methylpentane, 2,4'-dihydroxydiphenylsulfone, 4,4'-dihydroxydiphenylsulfone, 3,3'-diallyl-4,4'-dihydroxydiphenylsulfone, 4-hydroxy-4'-methyldiphenylsulfone, 1,1-bis(4-hydroxyphenyl)-1-phenylethane, 1,4-bis[α-methyl-α-(4'-hydroxyphenyl)ethyl]benzene and like phenolic compounds; N-p-tolylsulfonyl-N'-phenylurea, 4,4'-bis[(4-methyl-3-phenoxycarbonylaminophenyl)ureido] diphenylmethane, N-p -tolylsulfonyl-N'-p-butoxyphenylurea and like compounds having sulfonyl group(s) and/or ureido group(s) in their molecules; zinc 4-[2-(p-methoxyphenoxy) ethyloxy]salicylate, zinc 4-[3-(p -tolylsulfonyl)propyloxy] salicylate, zinc 5-[p-(2-p -methoxyphenoxyethoxy)cumyl] salicylate and like aromatic carboxylic acid zinc salt compounds; etc.

Examples of binders include polyvinyl alcohols of various molecular weights; modified polyvinyl alcohols; starch and derivatives thereof; methoxycellulose, carboxymethylcellulose, methylcellulose, ethylcellulose and like cellulose derivatives; sodium polyacrylate, polyvinyl pyrrolidone, acrylamide-acrylic acid ester copolymers, acrylamide-acrylic acid ester-methacrylic acid terpolymers, styrene-maleic anhydride copolymer alkali salts, polyacrylamide, sodium alginate, gelatin, casein and like water-soluble polymeric materials; polyvinyl acetates, polyurethanes, styrene-butadiene copolymers, polyacrylic acids, polyacrylic acid esters, vinyl chloride-vinyl acetate copolymers, polybutyl methacrylate, ethylene-vinyl acetate copolymers, styrene-butadiene-acrylic copolymers and like hydrophobic polymer lattices; etc.

Sensitizers can be used singly or in combination. Specific examples of sensitizers include stearamide, stearic acid methylene bisamide, stearic acid ethylene bisamide, 4-benzylbiphenyl, p-tolylbiphenyl ether, di(p -methoxyphenoxyethyl) ether, 1,2-di(3-methylphenoxy)ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(3-methylphenoxy)ethane, 2-naphthyl benzyl ether, 1-(2-naphthyloxy)-2-phenoxyethane, 1,3-di (naphthyloxy)propane, dibenzyl oxalate, di-p-methyl-benzyl oxalate, di-p-chlorobenzyl oxalate, dibutyl terephthalate, dibenzyl terephthalate, 2-(2'-hydroxy-5'-methylphenyl)benzotriazole, etc.

Examples of pigments include inorganic fine particles such as calcium carbonate, silica, zinc oxide, titanium oxide, aluminium hydroxide, zinc hydroxide, barium sulfate, clay, calcined clay, talc, surface-treated calcium carbonate, silica, etc.; organic fine particles such as urea-formaldehyde resins, styrene-methacrylic acid copolymers, polystyrene resins, etc.; and the like.

Among such pigments, it is preferable to use silica, particularly amorphous silica in the form of secondary particles having an average particle diameter of 30 to 900 nm formed by agglomeration of amorphous silica primary particles having a particle diameter of at least 3 and less than 30 nm. This allows molten components in the heat-sensitive recording material, which has been melted during recording with a thermal head, to be absorbed rapidly and in a large amount, thereby suppressing sticking. Further, by controlling the particle diameter, scratching is suppressed, and, due to its high transparency, recording sensitivity is improved.

The particle diameter of amorphous silica primary particle used for the heat-sensitive recording layer is usually at least 3 and less than 30 nm, particularly 3 to 29 nm, preferably 5 to 27 nm, and more preferably 7 to 25 nm.

The average particle diameter of the secondary particles is usually 30 to 900 nm, preferably 40 to 700 nm, more preferably 50 to 500 nm, and particularly 50 to 450 nm.

Calculation of the particle diameter of primary particle and the average particle diameter of secondary particles is described below in the Examples.

Usable auxiliaries include lubricants, anti-foaming agents, wetting agents, preservatives, fluorescent brighteners, dispersing agents, thickeners, colorants, antistatic agents and like known auxiliaries.

In the heat-sensitive recording layer of the present invention, the leuco dye content of the heat-sensitive recording layer is generally about 3 to about 50 mass % (and preferably about 5 to about 20 mass %), and the developer content is generally about 3 to about 60 mass % (and preferably about 5 to 40 mass %). The binder content is generally about 3 to about 50 mass % (and preferably about 5 to about 20 mass %)

When sensitizer(s) is contained, the sensitizer content is preferably about 10 to about 40 mass %. The lubricant content is preferably about 5 to about 20 mass %, and the pigment content is preferably about 10 to about 50 mass %.

The heat-sensitive recording layer coating composition of the present invention may be prepared and applied by a commonly known method. For example, the heat-sensitive recording layer coating composition may be prepared such that leuco dyes and developers are each pulverized and dispersed together with a binder solution by using a ball mill or like disperser, and then mixed and stirred optionally with sensitizers, pigments and/or other auxiliaries. Subsequently, such a heat-sensitive recording layer coating composition is applied to the undercoat layer by a known method, and then dried.

The method for applying the heat-sensitive recording layer coating composition is not limited, and known methods such as air-knife coating, blade coating, gravure coating, rod coating, short-dwell coating, curtain coating and die coating can be employed.

The amount of heat-sensitive recording layer coating composition applied is not limited. The desired quality can be achieved when the amount is about 1 to about 15 g/m$^2$, particularly about 2 to about 10 g/m$^2$ on a dry weight basis.

The heat-sensitive recording layer of the invention has a thickness standard deviation of 0.30 or less, preferably 0.25 or less, and more preferably 0.20 or less. Because of such a uniform recording layer having small variation in thickness, it is possible to provide a heat-sensitive recording material having high sensitivity and excellent image quality. The standard deviation can be adjusted by controlling physical properties, such as viscosity, of the heat-sensitive recording layer coating composition.

Particularly, in the present invention, because a heat-sensitive recording layer is formed on the undercoat layer having a first undercoat layer formed by blade coating and second and subsequent undercoat layers formed thereon by rod coating, thickness with a standard deviation as above can be readily achieved. When the smoothness of the undercoat layer is 200 to 1200 seconds (preferably 300 to 1000 seconds), thickness with a standard deviation as above can be achieved even more readily.

In the present invention, the thickness of each layer is determined by using an electron microscope to take a reflection electron compositional image of a cross section of the heat-sensitive recording material at a magnification of 1,000× to 3,000×, then measuring the thickness at five arbitrary points in the image, and obtaining the mean value of the three points among five arbitrary points, excluding the maximum and minimum. The thickness standard deviation of the heat-sensitive recording layer herein is calculated by using (Equation 1) based on thickness data obtained from the electron microscope observation.

$$s = \sqrt{s^2} = \sqrt{\frac{1}{n}\sum_{i=1}^{n}(x_i - x)^2} \quad \text{[Equation 1]}$$

wherein, s is the standard deviation, n is the number of data, $x_i$ is a datum value, and x is the mean value of the data.

Protective Layer

In the heat-sensitive recording material of the present invention, it is preferable to provide a protective layer on the heat-sensitive recording layer. This can improve preservability and runnability during recording.

Such a protective layer preferably has water-soluble polymer(s) and/or synthetic resin emulsion(s) as main components.

Examples of water-soluble polymers include completely or partially saponified polyvinyl alcohols, acetoacetyl modified polyvinyl alcohols, diacetone modified polyvinyl alcohols, carboxy modified polyvinyl alcohols, silicone modified polyvinyl alcohols and like polyvinyl alcohols; hydroxyethylcellulose, methylcellulose, carboxymethylcellulose and like cellulosic resins; gelatin; casein; styrene-maleic anhydride copolymer alkali salts; ethylene-acrylic acid copolymer alkali salts; styrene-acrylic acid copolymer alkali salts; etc.

Examples of synthetic resin emulsions include styrene-butadiene latices, acrylic latices, urethanic latices and like lattices.

Among these, modified polyvinyl alcohols having a degree of polymerization of 1000 or more are preferably used for the reasons that they improve surface barrier properties and enhance preservability such as chemical resistance. The upper limit of polymerization degrees is, but not limited to, usually about 5000, and preferably about 4500.

The total water-soluble polymer and/or synthetic resin emulsion (solids) contant is preferably about 30 to about 80 mass %, and more preferably about 40 to about 75 mass %, relative to the total solids of the protective layer. When the content is 30 mass % or more, barrier properties can be sufficiently exhibited. Moreover, the surface strength can be improved, and generation of paper dust and the like can be prevented. When the content is 80 mass % or less, worsening of thermal head sticking property can be prevented.

When a water-soluble polymer and a synthetic resin emulsion are both used, the ratio therebetween is such that the synthetic resin emulsion(s) (solids) is used in an amount of about 5 to about 100 parts by mass per 100 parts by mass of water-soluble polymer(s).

The protective layer can be obtained by applying a protective layer coating composition to the heat-sensitive recording layer, followed by drying. The protective layer coating composition is prepared by mixing and stirring, using water as a medium, water-soluble polymer(s) and/or synthetic resin emulsion(s) as above, optionally together with pigments and like various auxiliaries, Examples of pigments include inorganic pigments such as calcium carbonate, zinc oxide, aluminium oxide, titanium dioxide, amorphous silica, synthetic mica, aluminium hydroxide, barium sulfate, talc, kaolin, clay, calcined kaolin, etc.;- and organic pigments such as nylon resin fillers, urea-formalin resin fillers, raw starch particles, etc. Among these, kaolin, synthetic mica and aluminium hydroxide are preferable in that lowering of barrier properties against chemicals, such as plasticizers and oils, is suppressed, and lowering of recording density is also suppressed.

Amorphous silica is also preferable as a pigment. It is particularly preferable to use amorphous silica in the form of secondary particles having an average particle diameter of 30 to 900 nm, obtained by agglomeration of amorphous silica primary particles having a particle diameter of 3 to 70 nm. This suppresses sticking substantially completely or to such a level that practically no problems arise, and provides a heat-sensitive recording material causing reduced amount of residual substances to adhere to thermal heads, and having higher recording sensitivity and improved plasticizer resistance (barrier properties).

The particle diameter of amorphous silica primary particle used in the protective layer is preferably 3 to 70 nm, more preferably 5 to 50 nm, and yet more preferably 7 to 40 nm.

The average particle diameter of the secondary particles is preferably 30 to 900 nm, more preferably 40 to 700 nm, and yet more preferably 50 to 500 nm.

Calculation of the particle diameter of primary particle and the average particle diameter of secondary particles is described below in the Examples.

The amount of pigment is about 5 to about 80 mass %, and particularly preferably about 10 to about 60 mass %, relative to the total solids of the protective layer. When the amount is 5 mass % or more, sliding over heat sensitive heads can be improved, and worsening of sticking and residual substance deposition to the head can be prevented. When the amount is 80 mass % or less, barrier properties are improved, and protective layer functionality can be greatly enhanced.

Examples of auxiliaries include zinc stearate, calcium stearate, polyethylene wax, carnauba wax, paraffin wax, ester wax and like lubricants; sodium alkylbenzene sulfonate, sodium dioctyl sulfosuccinate, sulfone-modified polyvinyl alcohols, sodium polyacrylate and like surfactants; glyoxal, boric acid, dialdehyde starch, methylolurea, epoxy-based compounds, hydrazine-based compounds and like water proofing agents (crosslinking agents); ultraviolet absorbers; fluorescent dyes; coloring dyes; release agents; antioxidants; etc. The amounts of auxiliaries can be suitably selected from a wide range.

The method for applying the protective layer coating composition is not limited, and known methods such as air-knife coating, blade coating, rod coating, short-dwell coating, curtain coating, die coating can be employed.

The amount of protective layer coating composition applied is, on a dry weight basis, about 0.5 to about 3.0 g/m$^2$ and preferably about 0.8 to about 2.5 g/m$^2$, and the thickness of the protective layer is about 0.4 to about 2.5 μm, and more preferably about 0.6 to about 2.0 μm. When the amount is 0.5 g/m$^2$ or more, the thickness can be 0.4 μm, and accordingly, the heat-sensitive recording layer can be effectively protected. When the amount is 3.0 g/m$^2$ or less, the thickness can be 2.5 μm or less, and accordingly, recording sensitivity can be enhanced, achieving improved legibility even when recording is carried out at low energy.

Paper Support

Suitable as a paper support for the heat-sensitive recording material of the present invention is a base paper obtained by mixing a small amount of water-soluble polymer, optionally together with fillers for papermaking, strengtheners, retention aids, sizing agents and/or the like into a pulp containing, as main components, LBKP, NBKP, DIP (waste paper pulp) and the like, and then, with use of a paper machine, making paper having a basis weight of about 30 to about 150 g/m$^2$.

Known fillers can be internally added to such a base paper, and examples thereof include kaolin, talc, titanium oxide, white carbon, calcium carbonate, etc. The filler content is suitably adjusted depending on paper strength and stiffness, and is preferably 10 mass %, or less relative to the absolute dry total weight of the base paper. In the production of waste paper pulp, nonionic surfactants are used during the deinking step, which may cause a heat-sensitive recording material obtained therefrom to have problems in respect of anti-background fogging properties and recorded portion preservability over time. However, the undercoat layer of the present invention having at least two layers is excellent in the above-mentioned properties.

In the present invention, various techniques known in the field of heat-sensitive recording material production can be applied as required. For example, after each or all of the layers are formed, supercalendering or like smoothing treatment may be applied thereto; the support for the heat-sensitive recording material may be provided with, on its rear surface, a protecting layer, a coating layer for printing, a magnetic recording layer, an antistatic layer, a thermal transfer recording layer, an ink jet recording layer and/or the like as required; the heat-sensitive recording material may be processed into an adhesive label by adhesive-processing the support rear surface; and the heat-sensitive recording material may also be perforated. It is also possible to give the heat-sensitive recording layer of the heat-sensitive recording material multicolor recording capability.

EFFECT OF THE INVENTION

The present invention provides a heat-sensitive recording material having a high recording sensitivity, which is capable of providing excellent image quality even when recording is carried out at low energy, and causes reduced coating defects.

BEST MODE FOR CARRYING OUT THE INVENTION

The present invention is described in more detail below with reference to Examples; however, the present invention is not limited thereto. In the Examples, "parts" and "%" represent "parts by mass" and "% by mass", respectively, unless otherwise specified.

The standard deviation of the heat-sensitive recording layer thickness, and thicknesses of the undercoat layer and the protective layer thickness were determined in the following manner.

Standard Deviation of the Heat-sensitive Recording Layer Thickness

The standard deviation of the heat-sensitive recording layer thickness was determined by taking a reflection electron compositional image of a cross section of the heat-sensitive recording material by using an electron microscope at a magnification of 1,000× to 3,000×, then measuring the thickness of the heat-sensitive recording layer at five arbitrary points of the image, obtaining the mean value of the three points among five arbitrary points, excluding the maximum and minimum, and calculating the standard deviation by using (Equation 2) based on the obtained thickness data.

$$s = \sqrt{s^2} = \sqrt{\frac{1}{n}\sum_{i=1}^{n}(x_i - x)^2} \quad \text{[Equation 2]}$$

wherein s is the standard deviation, n is the number of data, $x_i$ is a datum value, and x is the mean value of the data.

Undercoat layer thickness and protective layer thickness

The undercoat layer thickness and the protective layer thickness were determined by taking a reflection electron compositional image of a cross section of the heat-sensitive recording material by using an electron microscope at a magnification of 1,000× to 3,000×, then measuring the thickness of each layer at five arbitrary points of the image, and calculating the mean value of the thickness of three points among the five arbitrary points, excluding the maximum and minimum values.

The "average secondary particle diameter" described herein of commercially available silica used in the heat sensitive recording layer coating composition and in the silica dispersion is the value shown in the manufacturer's catalog, unless otherwise specified.

With respect to the commercially available silica used in the silica dispersion and silica dispersion after pulverization and dispersion, the "particle diameter of primary particles" is a value calculated from formula (2) shown below using the specific surface area value. With respect to the silica dispersion after pulverization and dispersion, the "average particle diameter of secondary particles" is a value obtained according to the method described below in the section <Average particle diameter of secondary particles>.

Herein, the particle diameter $D_p$ of primary particles is calculated by the following formula:

$$\text{Asp}(m^2/g) = \text{SA} \times n \quad (1)$$

wherein Asp is the specific surface area, SA is the surface area of a single primary particle, and n is the number of primary particles per gram.

$$D_p(\text{nm}) = 3000/\text{Asp} \quad (2)$$

wherein $D_p$ is the particle diameter of primary particles, and Asp is the specific surface area.

Formula (2) is derived based on the assumptions that silica is exactly spherical, and density d of the silica is 2 ($g/cm^3$).

Herein, the specific surface area of amorphous silica was determined by drying a fine pigment (i.e., the amorphous silica used in the invention) at 105° C. and measuring the nitrogen absorption-desorption isotherm of the obtained powder sample using a specific surface area measuring apparatus ("SA3100", manufactured by Coulter) after vacuum degassing at 200° C. for 2 hours and calculating the BET specific area.

Thus the particle diameter of primary particles of amorphous silica used in the invention was obtained by measuring the specific surface area using the specific surface area measuring apparatus (SA3100, manufactured by Coulter) and calculating the particle diameter from formula (2).

<Average Particle Diameter of Secondary Particles>

The average particle diameter of secondary particles was determined in the following manner. The silica dispersion obtained was diluted with water to a concentration of 5 mass %. The diluted silica dispersion was stirred and dispersed using a homomixer at 5,000 rpm for 30 minutes, and the resulting dispersion was then immediately applied to a hydrophilicated polyester film in an amount of about 3 $g/m^2$ on a dry weight basis and dried for use as a sample. The sample was observed with electron microscopes (SEM and TEM), and electron micrographs of the sample were taken at magnification of 10,000× to 400,000×. The Martin's diameters of the secondary particles in a 5-cm square were determined and the average of the Martin's diameters was calculated (see "Biryushi handbook (Handbook for Fine Particles)", Asakura Publishing, 1991, p. 52).

EXAMPLE 1

(1a) Preparation of an Undercoat Layer Coating Composition

A dispersion (average particle diameter: 0.6 μm) of 85 parts of calcined kaolin (trade name: Ansilex, manufactured by Engelhard Corporation, oil absorption: 90 ml/100 g) in 100 parts of water was mixed with 40 parts of a styrene-butadiene copolymer emulsion (solids content: 50%), 50 parts of a 10% aqueous solution of oxidized starch, and 1 part of carboxymethyl cellulose (trade name: Cellogen AG gum, manufactured by Dai-Ichi Kogyo Seiyaku Co., Ltd.) and stirred to give an undercoat coating composition. The coating composition had a viscosity of 34 mPa·s (measured using a Hercules viscometer at 8800 rpm using an E-bob) and 1380 mPa·s (measured using a BL viscometer at 60 rpm).

(1b) Preparation of Each Component

Preparation of Dispersion A (Preparation of leuco dye dispersion)

A composition consisting of 10 parts of 3-(N-ethyl-p-toluidino)-6-methyl-7-anilinofluoran, 5 parts of a 5% aqueous solution of methylcellulose, and 15 parts of water was pulverized using a sand mill to an average particle diameter of 0.3 μm, thus giving Dispersion A.

Preparation of Dispersion B (Preparation of Developer Dispersion)

A composition consisting of 10 parts of 2,4'-dihydroxydiphenylsulfone, 5 parts of a 5% aqueous solution of methylcellulose, and 15 parts of water was pulverized using a sand mill to an average particle diameter of 0.3 μm, thus giving Dispersion B.

Preparation of Dispersion C (Preparation of Sensitizer Dispersion)

A composition consisting of 20 parts of di-p-methylbenzyl oxalate, 5 parts of a 5% aqueous solution of methylcellulose, and 55 parts of water was pulverized using a sand mill to an average particle diameter of 0.3 μm, thus giving Dispersion C.

(1c) Preparation of a Heat-sensitive Recording Layer Coating Composition

A composition consisting of 25 parts of Dispersion A, 50 parts of Dispersion B, 50 parts of Dispersion C, 20 parts of a fine particle amorphous silica dispersion (trade name: SYLOJET 703A, average secondary particle diameter: 300 nm, particle diameter of primary particles: 11 nm, specific surface area: 280 $m^2/g$, average particle diameter of secondary particles: 300 nm, solids content: 20%, manufactured by Grace Davison Co.), 30 parts of a 20% aqueous solution of oxidized starch, and 50 parts of a 10% aqueous solution of acetoacetyl-modified polyvinyl alcohol (trade name: "GOHSEFIMER Z-200", manufactured by Nippon Synthetic Chemical Industry Co., Ltd.) was mixed and stirred to give a heat-sensitive recording layer coating composition.

(1d) Preparation of a Heat-sensitive Recoding Material

The undercoat layer coating composition was applied to one side of a 48 $g/m^2$ base paper in an amount of 7.0 $g/m^2$ on a dry weight basis by blade coating and dried to form a first undercoat layer. Without winding this paper, the undercoat layer coating composition was applied to the first undercoat layer in an amount of 8.0 $g/m^2$ on a dry weight basis by rod coating and dried to form a second undercoat layer. The heat-sensitive recoding layer coating composition was applied to the two-layer undercoat layer in an amount of 5.0 $g/m^2$ on a dry weight basis and dried. The paper thus coated was then supercalendered under a nip pressure of 78 N/m for smoothing treatment, thus giving a heat-sensitive recording material.

EXAMPLE 2

(2a) Preparation of a Protective Layer Coating Composition

A dispersion of 50 parts of kaolin (trade name: UW-90, manufactured by Engelhard Corporation) in 100 parts of water was mixed with 600 parts of a 10% aqueous solution of acetoacetyl-modified polyvinyl alcohol (trade name: "GOHSEFIMER Z-200", as above) and 25 parts of zinc stearate (trade name: Hidrin Z-8-36, solids content: 36%, Chukyo Yushi Co., Ltd.) and stirred to give a protective layer coating composition.

(2b) Preparation of a Heat-sensitive Recording Material

A heat-sensitive recording material was prepared in the same manner as in Example 1 except that after forming the heat-sensitive recording layer, the protective layer coating composition was applied in an amount of 1.3 $g/m^2$ on a dry weight basis and dried.

EXAMPLE 3

A heat-sensitive recording material was prepared in the same manner as in Example 1 except that the first and second undercoat layers were formed by applying the coating composition in amounts of 5. 0 $g/m^2$ and 10.0 $g/m^2$, respectively.

EXAMMPLE 4

A heat-sensitive recording material was prepared in the same manner as in Example 1 except that the first and second undercoat layers were formed by applying the coating composition in amounts of 5.0 $g/m^2$ and 5.0 $g/m^2$, respectively.

EXAMPLE 5

A heat-sensitive recording material was prepared in the same manner as in Example 1 except that the coating composition described below was used as the undercoat layer coating composition.

(5a) Preparation of an Undercoat Layer Coating Composition

A dispersion (average particle diameter: 0.6 μm) of 55 parts of calcined kaolin (trade name: Ansilex, manufactured by Engelhard Corporation, oil absorption: 90 ml/100 g) in 75 parts of water was mixed with 55 parts of fine hollow particles (trade name: AE-851, manufactured by JSR, solids content: 55%, average particle diameter: 0.9 μm), 40 parts of a styrene-butadiene copolymer emulsion (solids content: 50%), 50 parts of a 10% aqueous solution of oxidized starch, and 1 part of carboxymethyl cellulose (trade name: Cellogen AG gum, manufactured by Dai-Ichi Kogyo Seiyaku Co., Ltd.) and stirred to give an undercoat layer coating composition. The coating composition had a viscosity of 37 mPa·s (measured using a Hercules viscometer at 8800 rpm using an E bob) and 1580 mPa·s (measured using a BL viscometer at 60 rpm).

EXAMPLE 6

A heat-sensitive recording material was prepared in the same manner as in Example 1 except that after applying and drying the first undercoat layer, the paper was wound and the second undercoat layer was then applied and dried.

EXAMPLE 7

A heat-sensitive recording material was prepared in the same manner as in Example 2 except that the coating composition described below was used as the protective layer coating composition.

(7a) Preparation of a Silica Dispersion

Commercially available silica (trade name: Finesil X-45, average secondary particle diameter: 4500 nm, particle diameter of primary particles: 12 nm, specific surface area: 260 $m^2/g$, manufactured by Tokuyama Co., Ltd.) was dispersed in water and pulverized using a sand grinder. Pulverization and dispersion were then repeated using a wet-type Media-less Ultra-atomization technology device (trade name: Nanomizer, manufactured by Yoshida Kikai, Co., Ltd.) to form a 10% silica dispersion with an average particle diameter of secondary particles of 300 nm.

(7b) Preparation of a Protective Layer Coating Composition

A composition consisting of 300 parts of a 10% aqueous solution of acetoacetyl-modified polyvinyl alcohol (trade name: "GOHSEFIMER Z-200", manufactured by Nippon Synthetic Chemical Industry Co., Ltd.), 20 parts of acrylic resin (trade name: AM2250, solids content: 50%, manufactured by SHOWA HIGHPOLYMER CO., LTD.), 100 parts of the above silica dispersion, 25 parts of zinc stearate (trade name: Hydrin Z-8-36, solids content: 36%, manufactured by Chukyo Yushi Co., Ltd.), and 20 parts of water was mixed and stirred to give a protective layer coating composition.

COMPARATIVE EXAMPLE 1

A heat-sensitive recording material was prepared in the same manner as in Example 1 except that no second undercoat layer was formed.

COMPARATIVE EXAMPLE 2

A heat-sensitive recording material was prepared in the same manner as in Example 1 except that the first undercoat layer was formed by applying the coating composition in an amount of 15.0 g/m$^2$ and no second undercoat was formed.

COMPARATIVE EXAMPLE 3

A heat-sensitive recording material was prepared in the same manner as in Example 1 except that the second undercoat layer was formed by blade coating. The obtained heat-sensitive coating material had scattered coating defects (i.e. streak) that were frequently generated during the coating process for forming the second undercoat layer.

COMPARATIVE EXAMPLE 4

A heat-sensitive recording material was prepared in the same manner as in Example 1 except that the first and second undercoat layers were formed by bar coating.

COMPARATIVE EXAMPLE 5

A heat-sensitive recording material was prepared in the same manner as in Example 2 except that the first undercoat layer was formed by applying the coating composition in an amount of 15.0 g/m$^2$ and no second undercoat layer was formed.

COMPARATIVE EXAMPLE 6

A heat-sensitive recording material was prepared in the same manner as in Example 2 except that the second undercoat layer was formed by blade coating.

Thirteen kinds of heat-sensitive recording materials thus obtained were evaluated for the following properties. Table 1 shows the results.

Smoothness (Oken smoothness; J. TAPPI No. 5)

The undercoat uppermost layer of the heat-sensitive recording material was measured for smoothness using an Oken-type smoothness tester.

Recording Sensitivity

Each heat-sensitive recording material was subjected to color development at 0.16 mJ/dot by using a thermal recording tester (trade name: TH-PMD, manufactured by OKURA DENKI) to record an image. The density of the recorded portion was measured with a Macbeth densitometer (trade name: RD-914, manufactured by Macbeth) in visual mode.

Image quality

The coloring condition of the recorded portion thus formed at 0.16 mJ/dot was observed under a microscope and evaluated according to the following criteria:

A: Dots were uniform in terms of coloring, with no variations in density.

B: Small areas with no coloring were observed on the dots, but they were at acceptable levels.

C: Noticeable areas with no coloring were observed on the dots and great coloring density variations were observed with visual evaluation; thus presenting problems for practical use.

D: Many areas with no coloring were observed on the dots and extreme coloring density variations were observed.

Barrier Properties

A 50% ethanol solution was applied to background portions of the heat-sensitive recording material and allowed to stand. After drying, the heat-sensitive recording material was observed with the naked eye for color forming levels and evaluated according to the following criteria:

A: No color was observed; excellent barrier properties.

B: Color formed to a slight degree was observed; no problems were presented for practical use.

C: The area and degree of color was greater than B; thus presenting problems.

D: color was observed in most areas to an extreme degree; problems for practical use were presented.

TABLE 1

| | Undercoat layer | | | | | | | | Standard deviation of heat-sensitive layer thickness | Thickness of protective layer (μm) | | | |
|---|---|---|---|---|---|---|---|---|---|---|---|---|---|
| | First undercoat layer | | | Second undercoat layer | | | | | | | | | |
| | Viscosity* (mPa · s) | Coating method | Coating amount (g/m$^2$) | Viscosity* (mPa · s) | Coating method | Coating amount (g/m$^2$) | Smoothness (sec) | Thickness (μm) | | | Recording sensitivity | Image quality | Barrier properties |
| Ex. 1 | 1380/34 | Blade | 7.0 | 1380/34 | Rod | 8.0 | 360 | 13.6 | 0.09 | — | 1.28 | A | — |
| Ex. 2 | 1380/34 | Blade | 7.0 | 1380/34 | Rod | 8.0 | 360 | 13.6 | 0.09 | 1.1 | 1.18 | A | A |
| Ex. 3 | 1380/34 | Blade | 5.0 | 1380/34 | Rod | 10.0 | 290 | 13.2 | 0.16 | — | 1.26 | B | — |
| Ex. 4 | 1380/34 | Blade | 5.0 | 1380/34 | Rod | 5.0 | 250 | 8.6 | 0.12 | — | 1.22 | B | — |
| Ex. 5 | 1580/37 | Blade | 7.0 | 1580/37 | Rod | 8.0 | 640 | 14.2 | 0.10 | — | 1.32 | A | — |
| Ex. 6 | 1580/37 | Blade | 7.0 | 1580/37 | Rod** | 8.0 | 310 | 13.5 | 0.11 | — | 1.24 | B | — |
| Ex. 7 | 1380/34 | Blade | 7.0 | 1380/34 | Rod | 8.0 | 360 | 13.6 | 0.09 | 1.1 | 1.21 | A | A |
| Comp. Ex. 1 | 1380/34 | Blade | 7.0 | — | — | — | 170 | 5.9 | 0.61 | — | 0.93 | D | — |
| Comp. Ex. 2 | 1380/34 | Blade | 15.0 | — | — | — | 160 | 12.8 | 0.56 | — | 0.95 | D | — |
| Comp. Ex. 3 | 1380/34 | Blade | 7.0 | 1380/34 | Blade | 8.0 | 90 | 13.2 | 0.36 | — | 0.97 | D | — |
| Comp. | 1380/34 | Bar | 7.0 | 1380/34 | Bar | 8.0 | 120 | 12.9 | 0.47 | — | 0.96 | C | — |

TABLE 1-continued

| | Undercoat layer | | | | | | | | Standard deviation of heat-sensitive layer thickness | Thickness of protective layer (μm) | | | |
|---|---|---|---|---|---|---|---|---|---|---|---|---|---|
| | First undercoat layer | | | Second undercoat layer | | | | | | | | | |
| | Viscosity* (mPa · s) | Coating method | Coating amount (g/m$^2$) | Viscosity* (mPa · s) | Coating method | Coating amount (g/m$^2$) | Smoothness (sec) | Thickness (μm) | | | Recording sensitivity | Image quality | Barrier properties |
| Ex. 4 | | | | | | | | | | | | | |
| Comp. Ex. 5 | 1380/34 | Blade | 15.0 | — | — | — | 160 | 12.8 | 0.56 | 1.0 | 0.87 | D | D |
| Comp. Ex. 6 | 1380/34 | Blade | 7.0 | 1380/34 | Blade | 8.0 | 90 | 13.2 | 0.36 | 1.2 | 0.90 | D | C |

Notes:
*BL viscosity/Hercules viscosity
**After applying and drying the first layer, the paper was wound and the second layer was then applied and dried.

The results of Table 1 clearly show that the heat-sensitive recording material of the invention has excellent recording sensitivity and image quality.

The invention claimed is:

1. A heat-sensitive recording material comprising:

(i) a paper support, (ii) an undercoat layer formed on the paper support, and (iii) a heat-sensitive recording layer formed on the undercoat layer;

a) the undercoat layer having a multilayer structure comprising at least a first layer and a second layer formed on the first layer; and b) the heat-sensitive recording layer having a thickness standard deviation of 0.30 or less.

2. A heat-sensitive recording material according to claim 1, wherein the first undercoat layer and the second undercoat layer are formed from the same undercoat layer coating composition.

3. A heat-sensitive recording material according to claim 2, wherein the undercoat layer coating composition has a viscosity as measured by a Hercules viscometer at 8800 rpm of 25 to 40 mPa·s, and a viscosity as measured by a BL viscometer at 60 rpm of 700 to 2000 mPa·s.

4. A heat-sensitive recording material according to claim 1, wherein the ratio of the dry coating amount of the first undercoat layer to the dry coating amount of the second undercoat layer is 2:8 to 8:2.

5. A heat-sensitive recording material according to claim 1, wherein the total dry coating amount of the first undercoat layer and the second undercoat layer is, 5 to 35 g/m$^2$.

6. A heat-sensitive recording material according to claim 1, wherein the fist undercoat layer is formed by blade coating followed by drying, and the second undercoat layer is formed by rod coating followed by drying.

7. A heat-sensitive recording material according to claim 6, wherein, after the first undercoat layer is formed, the second undercoat layer is formed without winding the paper support provided with the first undercoat layer.

8. A heat-sensitive recording material according to claim 1, wherein the heat-sensitive recording layer further comprises a pigment, and said pigment is in the form of secondary particles having an average particle diameter of 30 to 900 nm formed by an agglomeration of amorphous silica primary particles having a particle diameter of at least 3 and less than 30 nm.

9. A heat-sensitive recording material according to claim 1 or 8, further comprising a protective layer formed on the heat-sensitive recording layer.

10. A heat-sensitive recording material according to claim 9, wherein the protective layer comprises a pigment, and said pigment is in the form of secondary particles having an average particle diameter of 30 to 900 nm formed by agglomeration of amorphous silica primary particles having a particle diameter of 3 to 70 nm.

11. A heat-sensitive recording material according to claim 9, wherein the protective layer has a thickness of 0.4 to 2.5 μm.

12. A method for producing a heat-sensitive recording material obtained by forming, on a paper support, an undercoat layer and then a heat-sensitive recording layer, the method comprising:

a first step of forming a first undercoat layer on the paper support by blade coating followed by drying, and a second step of forming a second undercoat layer on the first undercoat layer by rod coating followed by drying.

13. A method according to claim 12, wherein the second step is carried out after the first step without winding the paper support provided with the first undercoat layer.

14. A method according to claim 12, wherein coating compositions for forming the first undercoat layer and the second undercoat layer each have a viscosity as measured by a Hercules viscometer at 8800 rpm of 25 to 40 mPa·s, and a viscosity as measured by a BL viscometer at 60 rpm of 700 to 2000 mPa·s.

* * * * *